United States Patent [19]

Bargados

[11] 4,305,167

[45] Dec. 15, 1981

[54] AUTOMATIC BED MAKING DEVICE

[76] Inventor: Vicente Bargados, 7061 Coventry Cir., La Palma, Calif. 90680

[21] Appl. No.: 102,906

[22] Filed: Dec. 13, 1979

[51] Int. Cl.[3] ..... A47C 21/00

[52] U.S. Cl. ..... 5/488

[58] Field of Search ..... 5/13, 131, 488, 508, 5/509; 297/283

[56] References Cited

U.S. PATENT DOCUMENTS

| | | | |
|---|---|---|---|
| 2,934,770 | 5/1960 | Willis et al. | 5/13 |
| 3,581,321 | 6/1971 | Geary | 5/488 |
| 3,855,655 | 12/1974 | Propst | 5/488 |
| 3,946,450 | 3/1976 | Staggs | 5/488 |

*Primary Examiner*—Roy D. Frazier
*Assistant Examiner*—Alexander Grosz
*Attorney, Agent, or Firm*—Gilbert A. Thomas

[57] ABSTRACT

A bed making device with a structural support base adapted to receive springs and mattress with two horizontal guide members attached at either end of the base on each side. A carrier arm is slideably positioned on each pair of guide members and contains a retractable detent pin at the top. The pin attaches to a mating opening in the bed linens and the linens are attached to the pins at the foot of the bed. A reversible electric motor with a two position foot switch, limit switch and gear driven belt drive is attached to the arms electromechanically, thereby transmitting linear direction to the mechanism. The carrier arms are horizontally propelled simultaneously forward pulling the bed linens in place. When the linens are so positioned the detent pin is retracted and the arms continue forward to a position near the head of the bed where they stop automatically.

9 Claims, 6 Drawing Figures

FIG. 2.
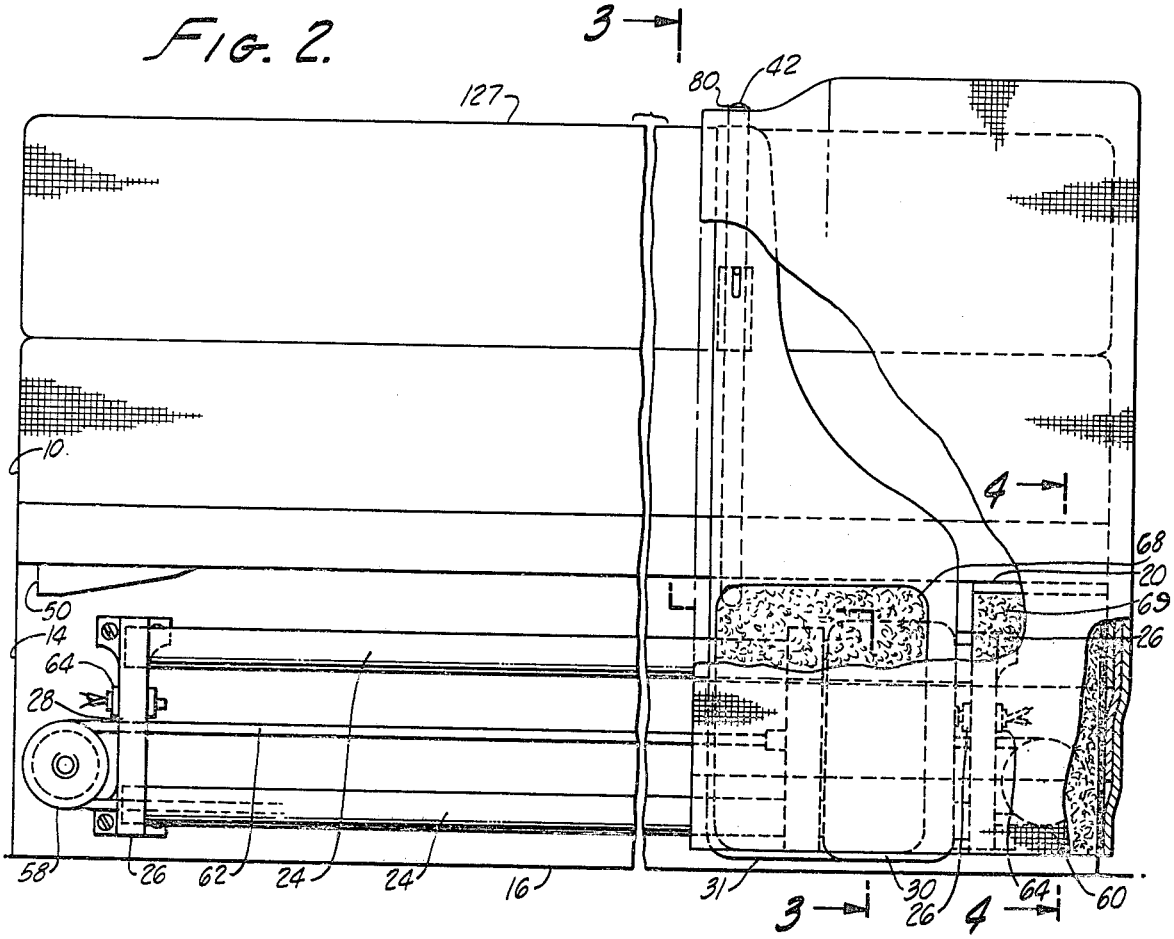
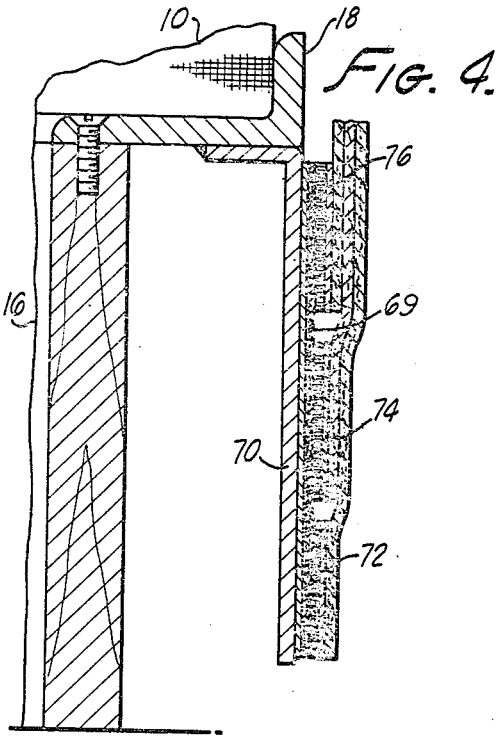
FIG. 4.
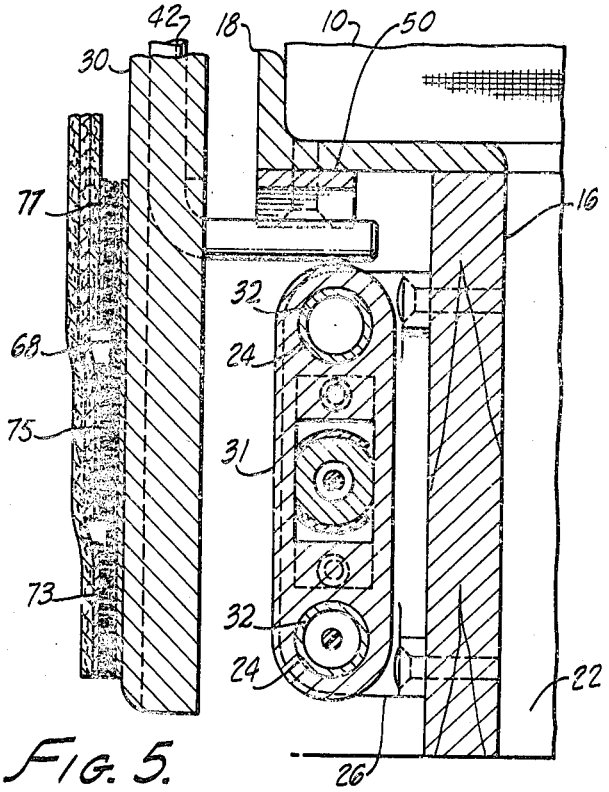
FIG. 5.

AUTOMATIC BED MAKING DEVICE

BACKGROUND OF THE INVENTION

1. Field of the Invention

This invention relates generally to beds and more specifically with attachments and accessories or cloth supports and holders and directly to automatic bed making devices.

2. Description of the Prior Art

Devices for making beds or assisting in the preparation for use are known. Staggs in U.S. Pat. No. 3,946,450 discloses such a device, however, the apparatus is integral with the bed and automatically removes and stores the linen on a roller, replacing the linen with a bedspread when not in use. U.S. Pat. No. 3,581,321 teaches a manual portable device with tucker rods to receive and hold the ends of bed coverings and tucks in the linen when it is retracted. Scriver in U.S. Pat. No. 3,388,406 discloses a power actuated apparatus utilizing a continuous strip of sheet material. This material is attached on a roller at either end of the bed to transfer fresh linen between rolls. A similar device is described by Sannes, U.S. Pat. No. 3,343,183, except the rollers are located in the longitudinal side of the bed. U.S. Pat. No. 2,620,491 by Allport utilizes an articulating frame that tilts and brings the mattress forward to enable the person making the bed to have easy access thereto. It is therefore noted that prior art in most cases requires highly specialized linen to be stored on rollers or manually spread linen tucked into place. The need for a device to easily and quickly make a bed with modified linen and mechanical assisted effort is long needed and the instant invention is directed to this end.

SUMMARY OF THE INVENTION

Devices for making beds have been in existence for many years. Complete automatic apparatus have required specialized bed linen and expensive rotating equipment to provide a completely automatic system. Other manual devices reduce the labor but still require spreading the linen, checking the sides to make them even and manually tucking them between the mattress and the springs.

With this in mind the primary object of the invention is to provide a device that locates top bed sheet, blanket and bedspread in its required position while the operator is only at the foot of the bed and does not require any further movement other than attaching them to the apparatus.

An important object of the invention allows a bed to be made in a formally inaccessable position such as in a tight corner of the room or between other beds where reaching across is required.

Another object of the disclosure is to allow the sheet, blanket and bedspread to be deposited in the exact location on the bed with respect to width and length without the need for visual and manual verification.

Yet another object of the invention provides a system of attaching bed coverings to a bed without the need of tucking the covering in place between the mattress and springs and still conveniently attaching the coverings on the outside of the bed with easy removal when they become soiled or it is necessary.

A further object of the invention provides a safety feature to prevent bodily injury or damaging the coverings if the material is mechanically caught or retained in any manner of the mechanism is urged deliteriously towards one's person.

There are other objects and advantages of the invention will become apparent from the subsequent detailed description of the preferred embodiment and the appended claims taken in conjunction with the accompanying drawings.

BRIEF DESCRIPTION OF THE DRAWINGS

FIG. 2 is a side view of the preferred embodiment with the center section deleted.

FIG. 4 is a partial cross-sectional view of the device taken along lines 4—4 of FIG. 2.

FIG. 5 is a cross-sectional view of the preferred embodiment taken along lines 5—5 of FIG. 6.

DESCRIPTION OF THE PREFERRED EMBODIMENT

Figure 1:
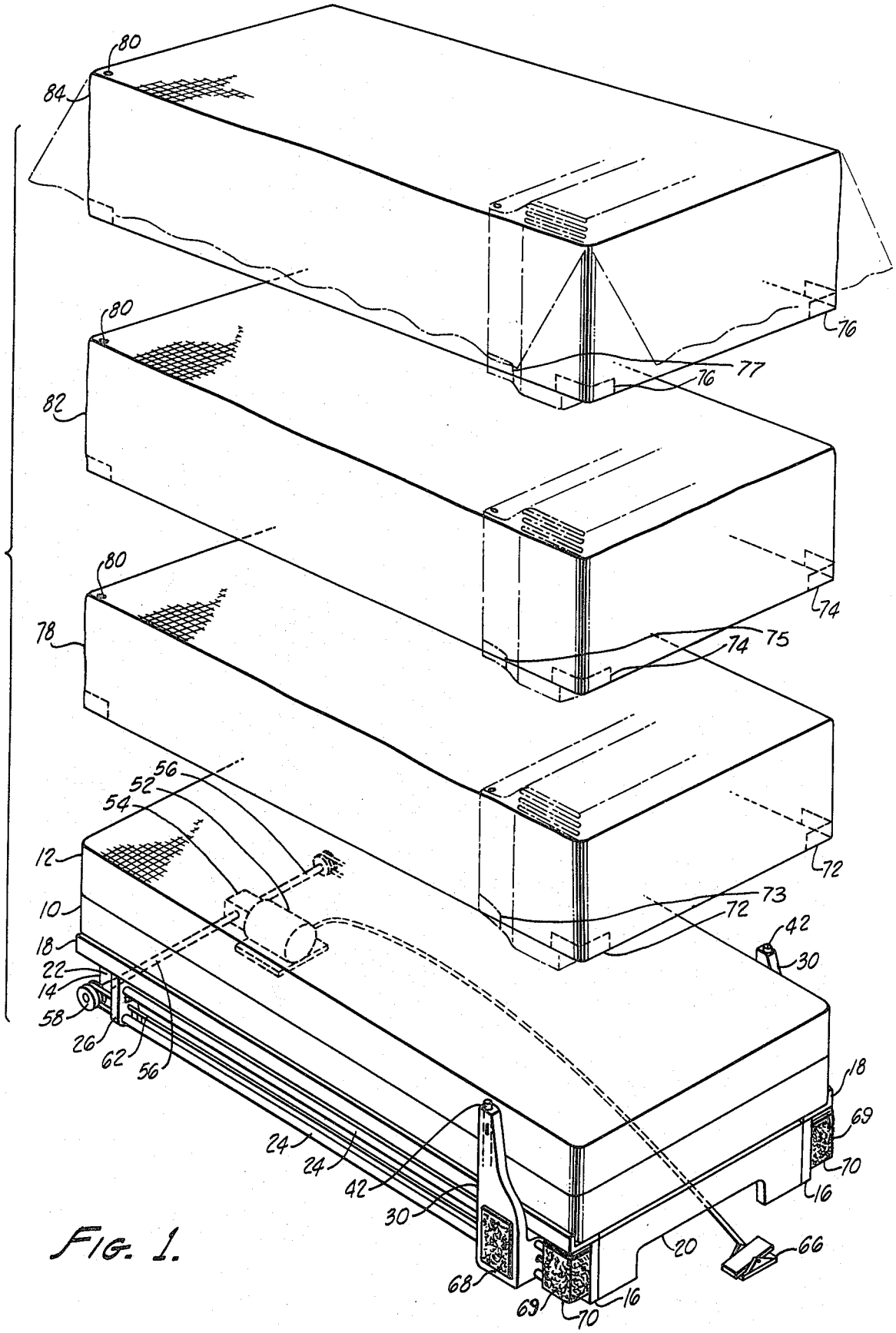
FIG. 1 is a partial isometric view of the preferred embodiment with the sheet, blanket and bedspread shown separate superimposed above the bed.
Figure 3:
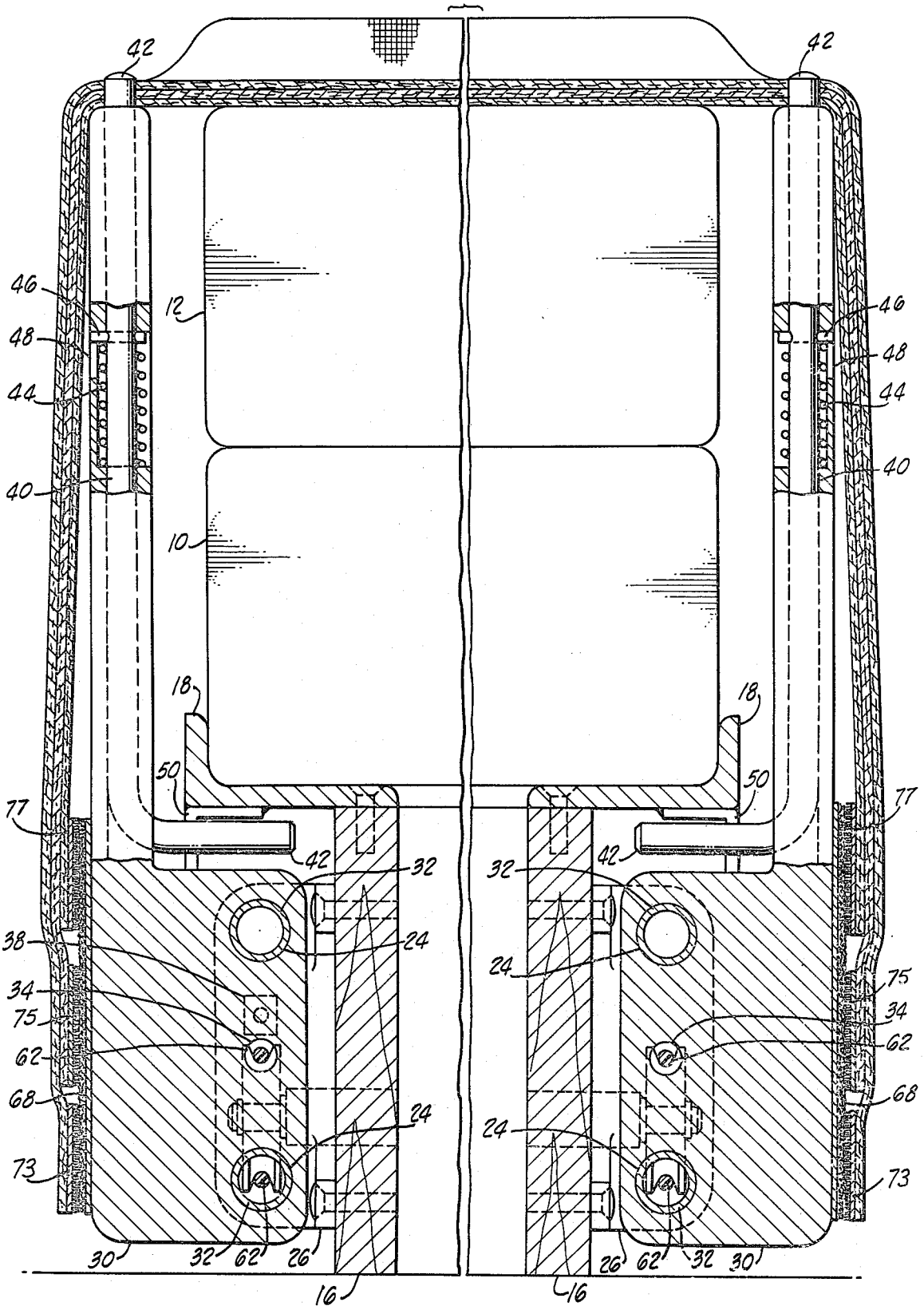
FIG. 3 is a partial cross-sectional view of the invention taken along lines 3—3 of FIG. 2.
Figure 6:
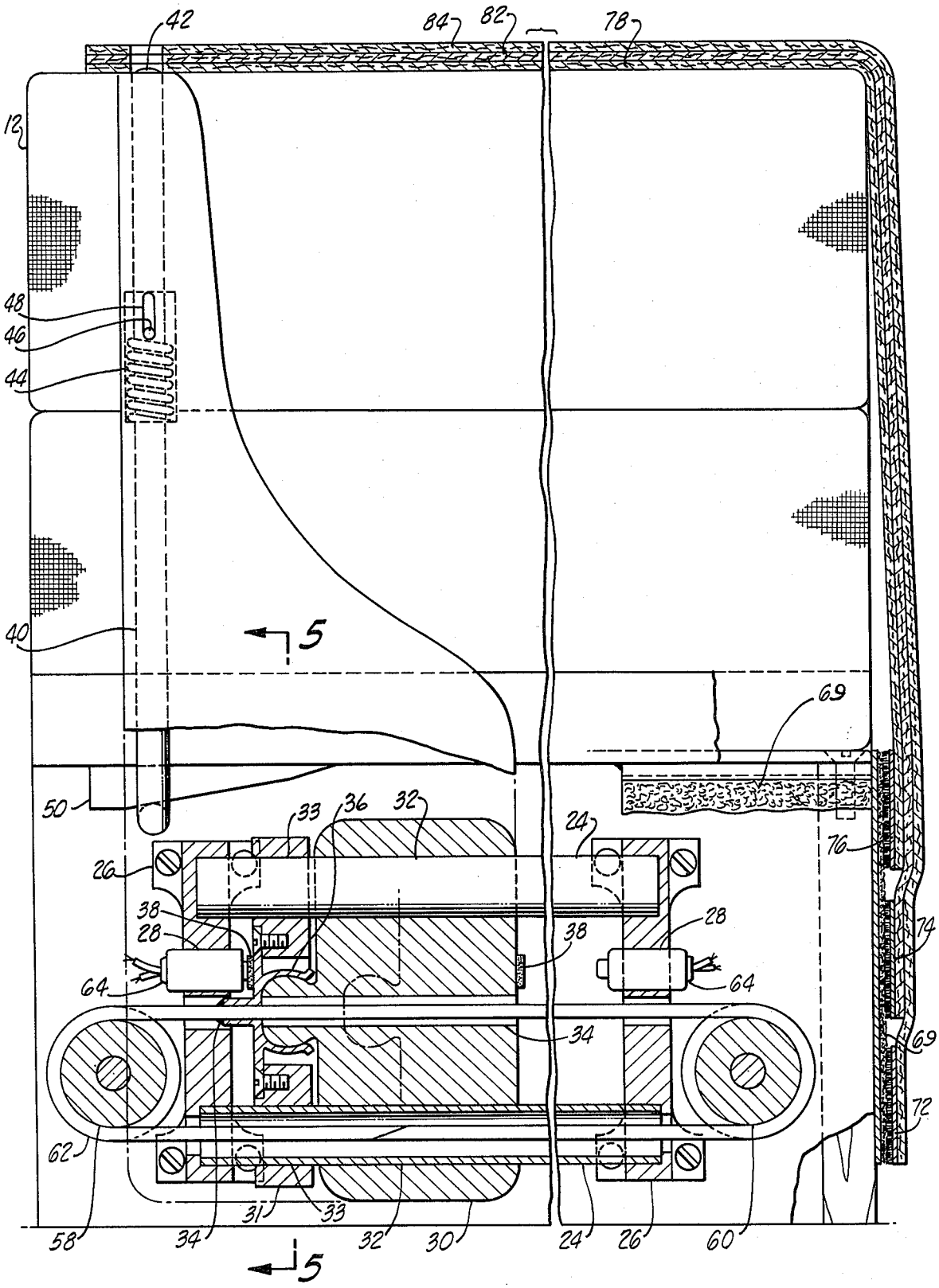
FIG. 6 is a side view of the device less the center portion with the carrier arm in its forward position and the detent pin retracted with the operating mechanism being partially cut away for clarity.

Referring now more particularly to the referenced characters of the drawing, the invention utilizes conventional bed springs 10 and mattress 12. The springs 10 and mattress 12 are supported by a base 14 consisting of at least a pair of longitudinal side members 16 extending the length of the bed one located on each side. A structural angle 18 is affixed to side members 16 with one leg vertical forming a channel between the two members to receive the springs 10. A foot base 20 and head base 22 are attached to the support member 16 forming a rectangular shaped frame. A pair of horizontal guide members 24 on each side extend almost the entire length of the bed and are planar with the side members 16. These members may be in any shape but are preferably round and are of sufficient structural integrity to support a slideable attached mechanism. The guide members 24 are essentially shorter than the length of the base and are parallel juxtaposed with each other. Each end of the guide member 24 is affixed by a retaining bracket 26 that receives the end of the guide member 24 in a socket providing a fixed parallel attaching point for each member. The guide member 24 is in turn attached with fastening means to the side members of the base 14 and space the guide members equidistant from the base. The retaining member 26 further contains a socket 28 to receive a limit switch 64 described later. The carrier arm 30 is slideable attached to the two guide members 24 on each side with bores 32 being slightly larger than the members allowing freedom of movement in a horizontal plane. The arm 30 is connected to an attaching sliding member 31 best depicted in FIG. 6 by a spring clip 36. The sliding member 31 has a plurality of bores 32 which likewise allows movement on the guide members 24. The sliding member 31 further has a hole 34 through which a continuous belt is retained also being described later. The propelled sliding member 31 is detachable from the arm 30 as a safety feature to allow movement of the assembly under normal operation and be disconnected if the arm strikes or presses against one's person accidentally. Also if the bed coverings become caught or otherwise retained from the normal unfolding and spreading operation this feature prevents the material from being damaged. The arm 30 and sliding member 31 may be easily reattached manually by embracing them together engaging the spring clip 36 into the mating surface of the arm structure. A resilient contact surface 38 is provided at right angles and attached to the retaining bracket in line with the limit switch 64 to cushion the impact of the carrier arm 30 on the switch plunger. The arm 30 includes a vertical extension that is the approximate height of the top of the mattress 12 and is provided with a vertical cavity 40 that contains a detent pin 42. This cavity 40 is slightly larger in size than the pin 42 allowing freedom of movement within the arm. The detent pin 42 is preferrably round and in the basic shape of an "L". The vertical leg is contained within the cavity 40 of the carrier arm 30 and protrudes vertically above the arm to provide the attaching means for the bed sheet, blanket and bedspread. The horizontal leg protrudes inwardly toward the center of the bed and is in close proximity to the parallel structural angles 18. The pin 42 is spring loaded upward to protrude above the arm 30 with a compression spring 44 located within an enlarged portion of the cavity 40 and a retaining pin 46 contains the spring 44. The retaining pin 46 also penetrates a slot 48 in the arm 30 continually positioning the detent pin horizontal leg inward toward the center of the bed yet allowing vertical travel. Tapered bearing surfaces 50 are fastened with attaching means to the structural angle 18 on both sides. The taper is preferrably triangular in shape with the largest leg toward the head of the bed. The bearing surface 50 is located in such a manner as to be in intimate contact with the horizontal leg of the detent pin 42. This contact retracts the pin from the carrier arm 30 by pulling the pin downward and pressing the spring 44 within its limitations as established by the pin 46 in the slot 48. This linear movement retracts the detent pin 42 at the top interface of the carrier arm 30 releasing the sheet, blanket and bedspread from the top of the arm depositing them at a predetermined position. The carrier arms 30 are simultaneously propelled longitudinally to transport the coverings between the arms from the foot to the head of the bed by the use of a reversable electric motor 52. This motor may contain speed reducing means or is inherently low speed in operation or the drive may be externally reduced in speed. The motor drive shaft is attached to a double right angle speed reducing gear box 54. This gear box 54 changes the rotational direction of the motor shaft 90° on each side allowing both sides of the bed to receive the torque of the motor. Shaft 56 transmits the energy from the gear box 54 on one end to a sheave 58 on the opposite end. The sheave 58 is located with the bottom of the groove in line with the lower horizontal guide member 24 and the top is parallel in alignment with the hole 34 in the carrier arm 30. Similar and mating driven sheaves 60 are located on the frame at the foot of the bed and are in alignment with the drive sheaves 58. A continuous belt 62 is positioned between the sheaves 58 and 60 and the frictional resistance caused by the mating groove and the shape of the belt or interlocking teeth cause the belt to move horizontally when the drive sheave 58 is rotated. The belt may be in the shape of a V groove, slotted, or cogged, with a preference to a round shape or in the form of a multi link chain. The belt 62 is attached to the sliding member 31 and pulls the arm 30 driving it linearally as the motor 52 is energized. The arm moves horizontally contained by the guide members 24. A limit switch 64 is located in a socket 28 of the retaining bracket 26 being operated by linear movement applied to the plunger thereby opening an electrical contact thus energizing the circuit to the motor 52. This switch allows the carrier 30 to move through their entire travel and automatically stop when they come in contact with the switch 64. The final component in the drive system is a foot actuated switch 66. This switch is electrically attached to the motor 52 and the limit switch 64. The switch 66 may be located in any position but is normally on the floor at the foot of the bed or located at the convenience of the operator. The switch 66 is a momentary single or double pole double throw type with a center off position. The switch 66 is actuated manually moving in either direction as selected by the operator. Hook or loop type tape 68 is attached to the carrier arms 30 and tape 69 to the attaching bracket 70, located at the foot of the bed attached to the longitudinal support member 16 on each side. The attached tape utilizes the hook side for the bracket 70. The bed coverings are modified by attaching loop type tape to the inside corner and foot side of the top sheet 78, tape 72 and tape 73, blanket 82, tape 74 and tape 75 and bedspread 84, tape 76 and tape 77. This so-called tape interfaces and attaches to the corresponding material on the back of the bracket 70 and arm 30 being spaced sequentially. The top sheet 78 also contains openings 80 at the head end near the corners of the bed front. These openings are preferably circular in shape to interface with the detent pin 42 and may be reinforced with plastic or metallic gromets or sewn with thread or the like. The blanket 82 and bedspread 84 contain a pair of similar openings 80.

In another embodiment, the bed contains water enclosed in a flexible sheath in lieu of the springs and mattress. The apparatus operates by first bringing the arms 30 to the foot end of the bed by energizing the switch 66.

A conventional bottom sheet is applied in the usual manner. The apparatus allows the operator to make the bed from the foot end. The top sheet 78 is unfolded to expose the openings 80 and is laid at the foot of the bed. The top sheet 78 is then attached to the apparatus by placing the openings 80 over the pins 42 in the arms 30. The loop tape 72 is attached to the hook tape 68 on the arm 30 by pressing manually in the upper third of the tape 68 in the two sides. The ends 72 of the top sheet are attached to the foot end frame bracket 70 by manually pressing the tape 72 on the upper third of the tape 69 attached to the bracket 70.

After the top sheet is attached to the arms 30 and to the brackets 70, the blanket 82 is attached on the middle third of the tape 68 on arms 30 with the ends 75 and on the middle third of the tape 69 on the bracket 70 with the tape ends 74. The same procedure is repeated with the cover 84 in the lower third of 68 and 69 with the ends pieces of tape 76 and 77.

After attaching the top sheet, blanket and cover in sequence on the arm 30 and the brackets 70, the foot switch is energized moving the arms 30 toward the headboard carrying the top sheet, blanket and bedcover simultaneously toward the head end.

As the arms 30 approach the headboard the detent pins 42 are retracted by coming into contact with the bearing surface so sliding out of the openings 80 depositing the top sheet, blanket and bedspread in their proper position on the bed. The arms 30 continue a short distance where the limit switch 64 then impedes the movement of the arm. At the completion of the operation the tape 73, 75 and 77 remains attached to the tape 68 on the arms 30 holding the covers securely in place without the need for tucking between the mattress or springs. For a person to get in bed, the top sheet, blanket and bedspread tape 73, 75 and 77 are removed manually from the tape 68 on the arms 30. To return the arms 30 back to "re-make" the bed, release the tape ends 73, 75 and 77 from the tape 68 on the arms 30, bring the covering ends to the center of the bed to clear the way of the arms 30, energize the foot switch 66 in the opposite direction until the arms 30 reach the foot end, then proceed with the same method. The tape 72, 74 and 76 remain attached to the foot end bracket 70.

While the invention has been described in complete detail and pictorially shown in the accompanying drawings it is not to be limited to such details since many changes and modifications may be in the invention without departing from the spirit and scope thereof. Hence, it is described to cover any and all modifications and forms which may come within the language and scope of the appended claims.

I claim:

1. An automatic bed making device for a bed with a mattress and springs comprising:

(a) a base having a head, parallel sides and a foot adapted to receive said mattress and springs;

(b) a plurality of horizontal guide members planar with said parallel sides being essentially shorter than the length of said base;

(c) a plurality of carrier arms slideably attached to said horizontal guide members with attaching means for bed covers and a continuous belt, a detachable body with a plurality of bores to slideably receive said horizontal guide members and detent pins in the cavity protruding vertically above the carrier arms providing the attachment means for bed coverings;

(d) means for longitudinally propelling said carrier arms simultaneously over the horizontal guide members to transport bed coverings between the arms from the foot to the head of the base, the invention further comprising on the detachable body a sliding member attached to the carrier arms body by a spring clip allowing the body to be disassembled for safety reasons.

2. The invention as recited in claim 1 in which said detent pins are: "L" shaped with a vertical member contained within said cavity in said carrier arms and a horizontal leg protruding inward nearly contiguous with said parallel sides of said base also being spring loaded vertically.

3. The device according to claim 2 further comprising: a tapered bearing surface affixed to said base at the head located in such a manner as to be in intimate contact with said horizontal leg of said detent pin and retracting the pin from said carrier arms depositing the bed coverings at a predetermined position.

4. The apparatus as recited in claim 1 in which the means for longitudinally propelling said carrier arms comprise:

(a) a reversible electric motor with a drive shaft;

(b) a double right angle speed reducing gear box attached to said drive shaft of the motor;

(c) a pair of drive shafts with a first and second end opposed to each other attached on the first end to said gear box;

(d) a pair of drive sheaves attached to the second end of said drive shafts adjacent to said guide members retaining brackets;

(e) a plurality of driven sheaves opposed to said drive sheaves;

(f) a continuous belt contageous to said drive and driven sheaves and engaged to said carrier arms to slideably drive the arms in a horizontal direction as contained by said guide member;

(g) a plurality of limit switches integral with said guide member retaining brackets to electrically impede the movement of said carrier arms by disengaging the electrical circuit of said motor; and (h) a foot actuated switch appended electrically to said motor to energize the motor and allow selection of the direction of rotation of the reversible motor to propel the carrier arms either to or away from the head of the base of the bed.

5. The invention as recited in claim 1 further comprising: corner brackets attached to said foot of the base containing on the exposed surface a hook filament fastening tape to provide attaching means for bed coverings.

6. The device set forth in claim 5 which further comprises: bed coverings with fastening means to slideably attach to said detent pins in said carrier arms and loop filament tape attached to said corners of said bed coverings in corresponding locations so as to coincide with the mating tape on said corner brackets and said carrier arms to hold said bed coverings in place.

7. Fastening means as recited in claim 6 to slideably attach said bed coverings to said detent pins wherein: said coverings contain circular openings in the corners of a spacing substantially equaling said detent pins.

8. The device as set forth in claim 1 in which the attaching means for bed coverings comprise: a hook filament tape affixed to the external surface of said carrier arms.

9. Bed coverings as set forth in claim 1 further comprising: a top sheet, blanket and bedspread.

* * * * *